US009004720B2

(12) United States Patent
Melzner et al.

(10) Patent No.: US 9,004,720 B2
(45) Date of Patent: Apr. 14, 2015

(54) RETAINING BRACKET FOR SPOTLIGHTS

(75) Inventors: Erwin Melzner, Frasdorf (DE); Jürgen Heinlein, Haimhausen (DE); Wolfgang Baumgartner, Künzing (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 2022 days.

(21) Appl. No.: 11/991,664

(22) PCT Filed: Sep. 6, 2006

(86) PCT No.: PCT/EP2006/008807

§ 371 (c)(1), (2), (4) Date: May 15, 2008

(87) PCT Pub. No.: WO2007/028643

PCT Pub. Date: Mar. 15, 2007

(65) Prior Publication Data

US 2009/0251905 A1 Oct. 8, 2009

(30) Foreign Application Priority Data

Sep. 8, 2005 (DE) ..... 20 2005 014 393 U

(51) Int. Cl.

| | |
|---|---|
| ***F21V 21/26*** | (2006.01) |
| ***F21V 21/34*** | (2006.01) |
| ***F21V 21/15*** | (2006.01) |
| ***F21V 21/30*** | (2006.01) |
| *F21W 131/406* | (2006.01) |

(52) U.S. Cl.

CPC ..... *F21V 21/34* (2013.01); *F21V 21/15* (2013.01); *F21V 21/30* (2013.01); *F21W 2131/406* (2013.01)

(58) Field of Classification Search

USPC ..... 362/418, 269, 220, 285, 286, 371, 372, 362/523, 526, 430; 353/119

See application file for complete search history.

(56) References Cited

U.S. PATENT DOCUMENTS

| | | | | | |
|---|---|---|---|---|---|
| 2,097,537 | A | * | 11/1937 | Snyder | 362/426 |
| 4,306,279 | A | * | 12/1981 | Cohen | 362/365 |
| 4,519,021 | A | * | 5/1985 | Oram | 362/277 |
| 5,176,442 | A | * | 1/1993 | Richardson | 362/286 |
| 6,428,197 | B1 | | 8/2002 | Downing | |

(Continued)

FOREIGN PATENT DOCUMENTS

DE 299 05 443 U1 7/1999

OTHER PUBLICATIONS

International Search Report, dated Dec. 5, 2006, corresponding to PCT/EP2006/008807.

(Continued)

*Primary Examiner* — Anh Mai
*Assistant Examiner* — Jessica M Apenteng
(74) *Attorney, Agent, or Firm* — Christie, Parker & Hale, LLP

(57) ABSTRACT

A retaining bracket for spotlights is provided. The retaining bracket comprising bracket bearings which are arranged at the ends of the retaining bracket, for accommodating the spotlight housing and a central supporting bearing for connecting the retaining bracket to a supporting apparatus The distance of the bracket bearings from one another is capable of being adjusted in self-centering fashion.

40 Claims, 5 Drawing Sheets

(56) References Cited

U.S. PATENT DOCUMENTS 6,953,270 B1 10/2005 Richardson
7,111,966 B1 * 9/2006 Jenkins ..... 362/420

OTHER PUBLICATIONS

English Translation of International Preliminary Examination Report, with Written Opinion, for corresponding International Application No. PCT/EP2006/008807, dated Apr. 8, 2008.

* cited by examiner

RETAINING BRACKET FOR SPOTLIGHTS

CROSS-REFERENCE TO A RELATED APPLICATION

This application is a National Phase Patent Application of International Patent Application Number PCT/EP2006/008807, filed on Sep. 06, 2006, which claims priority of German Utility Model Application Number 20 2005 014 393.6, filed on Sep. 08, 2005.

BACKGROUND

The invention relates to a retaining bracket for spotlights.

In order to connect spotlights for illumination purposes, in particular studio, television, theatre, event spotlights and the like, to a rig for a suspended arrangement or to a supporting rack or stand for a standing arrangement of a spotlight, retaining brackets are known which connect the spotlight housing to a crossmember of the rig or to the stand or substructure and have an axis of rotation and a pivot axis for rotating the spotlight about a vertical axis and for pivoting the spotlight about a horizontal axis. In particular when accommodating heavy spotlights, the retaining brackets are capable of being moved by means of a motor, i.e. are capable of being adjusted by means of a motor about the axis of rotation and pivot axis and additionally are capable of being remote controlled for suspension of the spotlight, for example on a studio ceiling or on a rig, so that the respective setting of the alignment of the spotlight can also be carried out by a person located at a distance from the spotlight. In particular for fitting the spotlight in such a way that it is arranged at a distance from the control location, the retaining bracket is additionally connected to a focusing adjustment drive, which is fitted on the spotlight housing and sets the desired focal width of the spotlight from SPOT, for a small, centered illumination area, to FLOOD, for a large illumination area.

Retaining brackets or remote controllable retaining brackets which are moved by means of a motor and are referred to as motor brackets comprise a bracket-shaped housing, whose bracket bearings have a predetermined distance from one another which is matched to the specific spotlight for the purpose of connection to the spotlight housing, so that the length of the bracket arms from the bracket bearings up to the supporting apparatus is matched to the respective spotlight. In order to accommodate and adjust spotlights of different sizes and powers, the provision of a correspondingly large number of retaining brackets or motor brackets is therefore required, which not only means a high space requirement for storing the motor or retaining brackets but also involves high investment costs.

SUMMARY

The object of the present invention is to provide a retaining bracket for spotlights of different powers and therefore different sizes of the spotlight housing which firstly is mounted in a space-saving manner and secondly is suitable for very large spotlights.

An exemplary solution according to an exemplary embodiment of the invention provides a retaining bracket for spotlights in a large power range and therefore for spotlights with spotlight housings of different sizes which therefore requires minimum investment costs and is characterized firstly by a minimum space requirement for the dedicated warehousing and storage and secondly by the fact that it can also be matched to very large spotlights.

Exemplary, the bracket bearings are capable of being adjusted in self-centering fashion, so that there is no displacement of the center of gravity when accommodating a spotlight, which is of considerable importance in particular in the case of large and heavy spotlights with the risk of static problems. Furthermore, as a result of the self-centering the optical axis of the various spotlights accommodated by the retaining bracket is maintained.

In particular, both the distance of the bracket bearings from one another and their distance from the supporting bearing is adjustable, so that matching to different spotlight housings in all directions can be performed.

In an exemplary embodiment, the bracket bearings are capable of being pivoted about a pivot axis for setting the inclination of the spotlight, while the supporting bearing is rotatably connected to the supporting apparatus for the purpose of rotating the spotlight about a vertical axis of rotation. As a result, different regions can be illuminated without the position of the spotlight being changed.

Exemplary, the retaining bracket comprises a frame construction which is preferably rigid in terms of connections and with a crossmember and bracket arms, which are connected to the crossmember and on whose end sections the bracket bearings are arranged.

This configuration of the retaining bracket allows for simple manufacture and fitting using standardized component parts, in particular when, in accordance with a further feature of the invention, the crossmember and the bracket arms comprise mutually adjustable rods or tubes.

In order to set the distance of the bracket bearings from one another, the crossmember and the bracket arms are connected to one another via adjustable coupling elements.

In accordance with a further exemplary feature of the invention, the crossmember comprises a rectangular frame with cross tubes, which are connected via lateral flanges, while the bracket arms are designed to be L-shaped and have horizontal and vertical arms, which are spaced apart with respect to one another by the length of the lateral flanges of the crossmember and are connected to one another via cross arms, with the horizontal arms being connected to the coupling elements and the vertical arms being connected to the bracket bearings.

In order to set the distance of the bracket bearings from one another in a simple manner, the coupling elements are adjustable along the cross tubes of the crossmember and preferably synchronously adjustable via a drive device, which is connected to the crossmember.

This exemplary configuration of the solution according to the invention allows for self-centering adjustment of bracket bearings and therefore optimum mounting with respect to the center of gravity of a spotlight in the retaining bracket.

In one exemplary embodiment, the drive device comprises a spindle drive with a drive motor, at least one spindle and spindle nuts, which are connected to the coupling elements and in which the at least one spindle engages.

Alternatively, provision can be made for a spindle, which is connected to the drive motor, with opposed threads, which engage in spindle nuts, which are connected to the coupling elements, with a left-handed thread on one side and a right-handed thread on the other side, or there are arranged two spindles, which are connected to the drive motor and whose threads engage in spindle nuts, which are connected to the coupling elements.

In order to securely mount the spindles, they are supported on the flanges of the crossmember.

In order to optimize the operation of the retaining bracket in particular for its remote control, the crossmember is connected to an adapter, drive and control module, which has an adapter for connecting the retaining bracket to the supporting apparatus, the drive motor of the spindle drive and a drive motor for rotating the retaining bracket about the vertical axis of rotation, a first sensor for detecting the rotary angle of the retaining bracket and a control device, which is connected to a first sensor for detecting the rotary angle of the retaining bracket, a setpoint encoder and the drive motors.

The adapter and flange plate can additionally be connected to a safety suspension device for a suspended operation of the retaining bracket.

In order to set the distance of the bracket bearings from one another, stored values of spotlight housing data can be called up, and the distance between the bracket bearings and/or the contact pressure between the bracket bearings and the spotlight housing can be detected by means of a second sensor.

In order to connect the retaining bracket to a spotlight in a simple and rapid manner, in particular in order to exchange spotlights rapidly, the bracket bearings have a pivot drive for rotating adapter or flange plates, which are connected to the bracket bearings, for accommodating the spotlight housing and setting the inclination of the spotlight about the pivot axis with the adapter or flange plates preferably being equipped with a quick-action fastening device.

The axis of rotation can also be connected to an adapter plate, to which the standard fastening elements such as studio pins, tubular clamps or special adapters such as so-called "Mitchell adapters", for example, can be flange-connected.

In order to optimize control, the pivot drive is connected to the control device of the adapter, drive and control module.

In order to set the distance of the bracket bearings from the supporting bearing, it is possible to change the connection between the bracket bearings and the vertical arms of the bracket arms by, as an alternative, a spindle or telescope drive, which is connected to the bracket bearings and the crossmember, being provided or by the articulation of the bracket bearings on the bracket arms being variable, for example, by means of drilled holes, which are offset with respect to one another, in the bracket arms and pins, plug-in sleeves or the like.

In order to protect against damage to the spotlight or injury to personnel when actuating one of the drive devices, the drive devices are connected at least partially via a friction coupling to the respective adapter or flange.

One exemplary configuration of the invention is characterized by remote control for driving at least some of the functions of the retaining bracket, which remote control is connected, in particular via a Digital Multiplex (DMX) interface or wirelessly, to the control device of the retaining bracket.

In particular when connecting the retaining bracket to a rig or a crossmember, preferably all of the functions of the retaining bracket can be set or stored and called up from remote locations by means of remote control without complex control at the location of the spotlight being required for this purpose.

In order to be able to set the illumination area as well in particular in the case of remote control of the retaining bracket which can be adjusted by means of a motor, in accordance with a further feature of the invention, the adapter, drive and control module is connected to a focusing drive device for adjusting the light exit angle of the spotlight, which focusing drive device is arranged in a focusing transmission housing, which can be flange-connected to the spotlight housing, and is connected to the adapter, drive and control module via a control and power supply line.

In order to set the maximum pivoting range of the spotlight, the control module is programmable and is provided with a program-controlled shut-off limit device, preferably the pivoting speed of the spotlight being continuously regulable and the control device of the adapter, drive and control module having a PID regulating device for regulating the starting and braking response of at least one of the drive devices of the retaining bracket.

By means of coupling the vertical axis of rotation and the horizontal pivot axis to rotary angle encoders, additionally a position signal can be emitted to the control device of the adapter, drive and control module.

BRIEF DESCRIPTION OF THE DRAWINGS

The features of the invention and the concept on which the invention is based will be explained in more detail with reference to an exemplary embodiment illustrated in the figures, in which.

DETAILED DESCRIPTION

Figure 1:
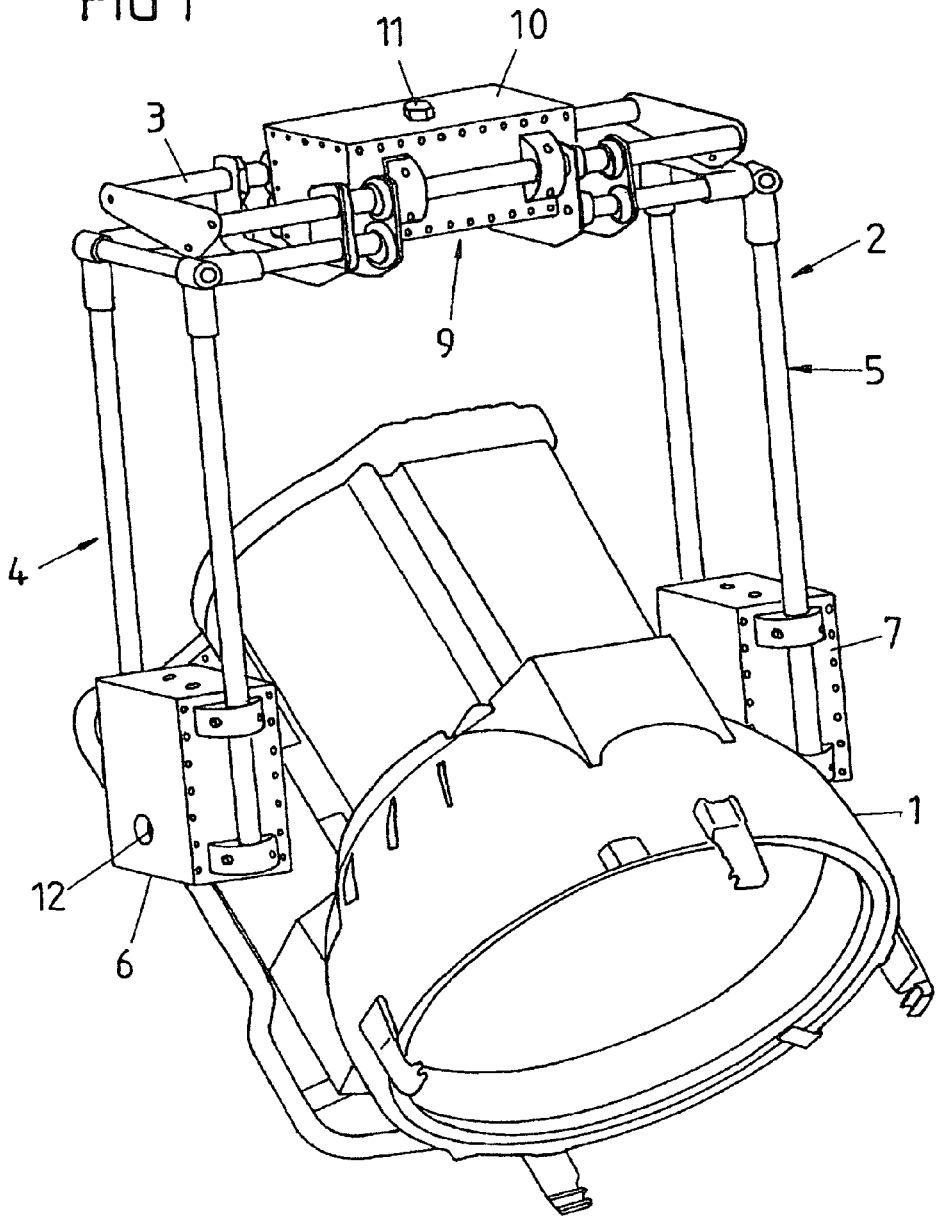
FIG. 1 shows a perspective illustration of a spotlight, which is connected to a remote-controllable retaining bracket, which is moved by means of a motor, with an axis of rotation, pivot axis and focusing adjustment axis.

In FIGS. 1 to 7 of the drawing, the individual functional parts of the retaining bracket according to the invention have been provided with respectively corresponding reference numerals, so that where there is no mention of a functional element in the description of the individual figures of the drawing, reference is made to the meaning and function of this part in the description of the other figures.

FIG. 1 shows a spotlight 1, which is inclined about a horizontal pivot axis 12 and is connected to a frame-shaped retaining bracket 2 in a suspended arrangement. The retaining bracket 2 can be connected via a vertical axis of rotation 11 to a supporting apparatus, for example to the crossmember of a rig for the suspended arrangement of the spotlight 1, and is capable of rotating about the vertical axis of rotation 11, so that the spotlight 1 can be aligned with different illumination areas both with respect to its inclination and with respect to the rotary angle. As a result of rotary angle encoders being coupled to or integrated in the vertical axis of rotation 11 and the horizontal pivot axis 12, the respective position signal of the rotary angle and the inclination of the spotlight 1 is emitted as an actual value to the control device of the adapter, drive and control module 10.

Figure 2:
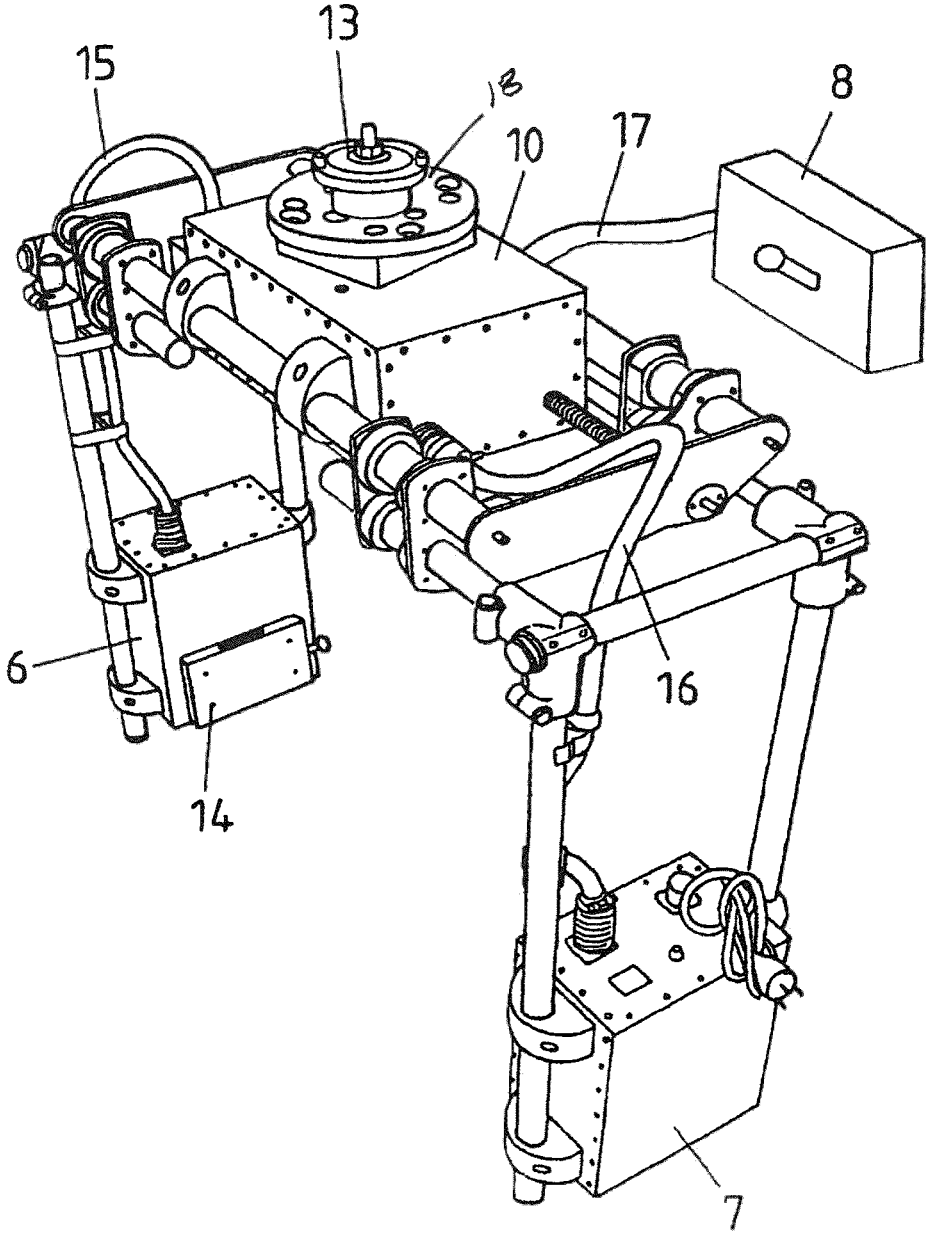
FIG. 2 shows a perspective illustration of the retaining bracket shown in FIG. 1 with an adapter plate for a crossmember and adapter and flange plates for accommodating a spotlight housing.

In addition, the focal axis of the spotlight 1 can be connected to a focusing drive device 8 as shown in FIG. 2, via which the light exit angle of the spotlight 1 can be set.

The frame construction of the retaining bracket 2 which is rigid in terms of connections comprises a crossmember 3 in the form of a rectangular frame and two bracket arms 4, 5, which protrude substantially at right angles from the crossmember 3 and on whose ends opposite the crossmember 3 bracket bearings 6, 7 are arranged, which form the pivot axis 12 and are connected to the housing of the spotlight 1 in a suitable manner and possibly in such a way that they are adjustable in the longitudinal direction of the spotlight housing. The crossmember 3 is connected to an adapter, drive and control Module 10, which is connected to the vertical axis of rotation 11 for accommodating an adapter flange and possibly an additional safety suspension device 18. Standard fastening elements such as studio pins, tubular clamps or special adapters such as so-called "Mitchell adapters", for example, can be flange-connected to the adapter flange of the vertical axis of rotation 11.

In order to match the retaining bracket 2 to spotlights 1 of different powers and therefore generally of different housing dimensions, the distance of the bracket bearings 6, 7 with respect to one another is adjustable by means of a spindle drive 9, which will be described below with reference to FIGS. 2 to 4 and adjusts the bracket arms 4, 5 with respect to the longitudinal extent of the crossmember 3.

FIG. 2 shows, in an isometric illustration, the retaining bracket 2 without suspended spotlight 1 with an adapter and flange plate 13 for connecting the retaining bracket 2 to a supporting apparatus in the form of a rig or stand or substructure and the adapter and flange plates 14, which are connected to the pivot axis for setting the inclination of the spotlight, of the bracket bearings 6, 7. The adapter and flange plates 14 of the bracket bearings 6, 7 are connected to pivot drives (not illustrated in any more detail) for rotating the adapter plates 14, which are connected to the adapter, drive and control module 10 via control and power supply lines 15, 16, which adapter, drive and control module 10 contains a central control device, which is connected to a remote control means for setting the various functions of the retaining bracket via an air interface, with the remote control being connected to the control device of the retaining bracket via a DMX interface or wirelessly and makes it possible, in particular when the retaining bracket is connected to a rig or a crossmember, to set or call up stored data of functions of the retaining bracket from remote locations, without complex control at the location of the spotlight, which is often difficult to access, being required for this purpose.

The connection of a spotlight to the adapter plate 14 of the bracket bearings 6, 7 takes place by means of it being flange-connected or clipped on in conjunction with a clip or a hinged closure or a bayonet-type closure, so that rapid exchange of spotlights is ensured if required.

FIG. 2 also shows the connection of the module 10 to the focusing drive 8, which can be fitted onto the spotlight housing, via a control and power supply line 17.

Figure 3:
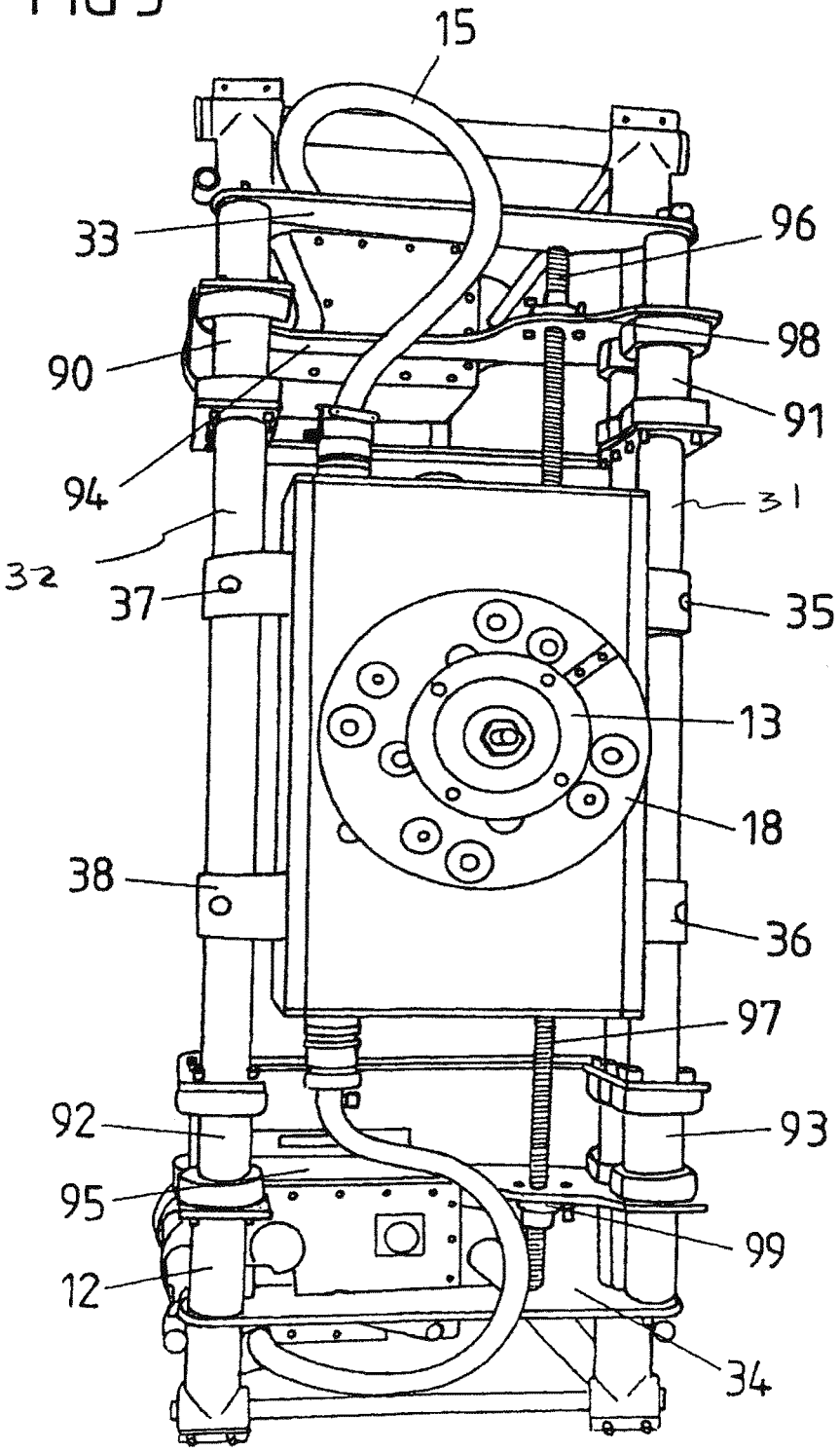
FIG. 3 shows a plan view of the retaining bracket shown in FIG. 2.

The crossmember 3 of the retaining bracket 2, corresponding to the plan view illustrated in FIG. 3 of the frame construction, comprises cross tubes 31, 32, which are connected to one another at their end sides via flanges 33, 34. The cross tubes 31, 32 are connected to the adapter, drive and control module 10 via bearings 35, 36, 37, 38 and are used for supporting and mounting coupling elements 90 to 93 of the spindle drive 9, which are connected to one another via connecting flanges 94, 95. The spindle drive 9 contains a spindle drive motor, which is arranged in the adapter, drive and control module and drives two spindles 96, 97, which engage in spindle nuts 98, 99, which are connected to the connecting flanges 94, 95. The spindles 96, 97 are supported on the flanges 33, 34 of the crossmember 3.

The coupling elements 90 to 93 are therefore displaced in the longitudinal direction of the crossmember 3 in the event of a rotation of the spindles 96, 97 by the spindle drive motor and therefore cause an adjustment of the bracket bearings 6, 7 with automatic centering of the center of gravity, so that spotlights with different housing dimensions and therefore generally with different powers can be accommodated by the retaining bracket 2 without a displacement of the center of gravity with respect to the vertical axis of rotation 11 taking place.

Figure 4:
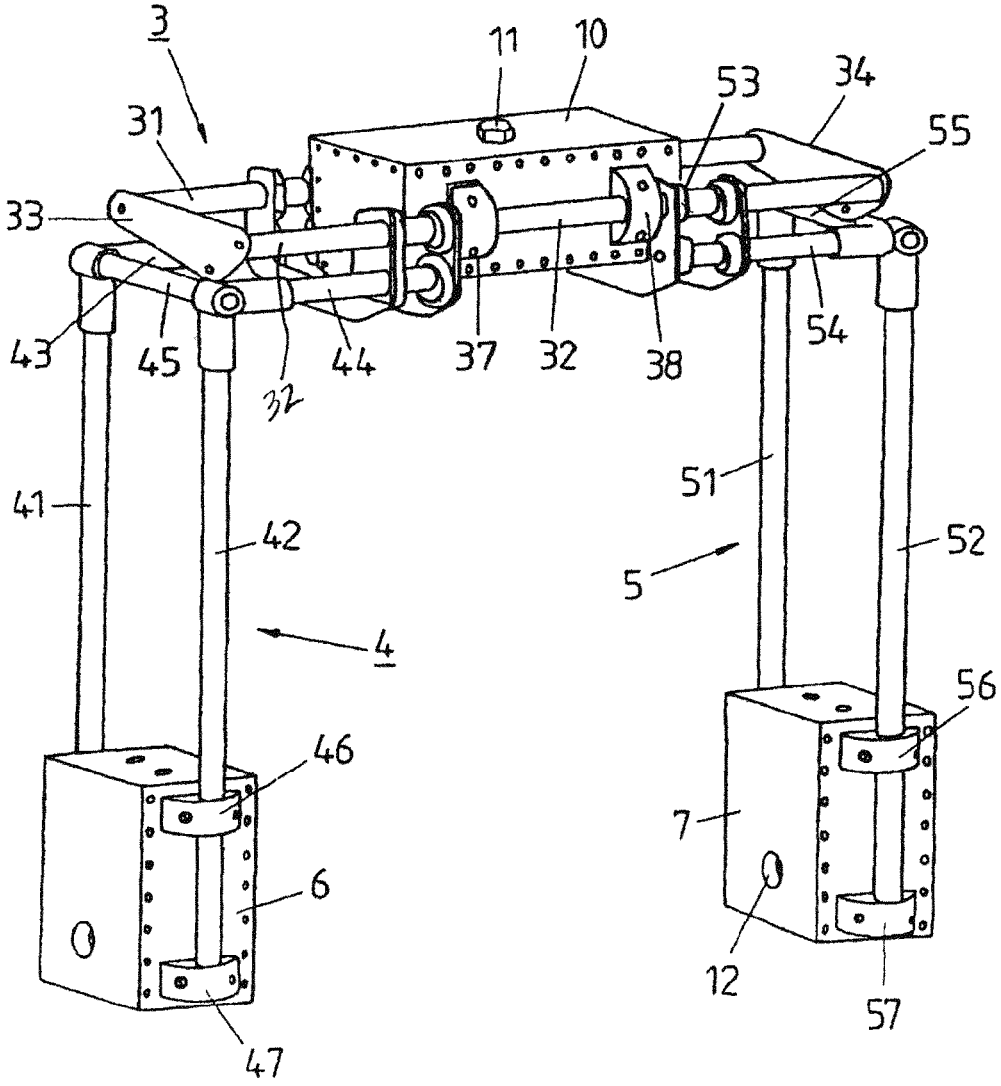
FIG. 4 shows a perspective illustration of the retaining bracket frame.

The bracket arms 4, 5 of the frame construction, as shown in FIG. 4, comprise parallel, vertical arms 41, 42 and 51, 52 and horizontal arms 43, 44 and 53, 54, which are aligned at right angles thereto, and cross arms 45 and 55, which are connected to one another via collars (not provided with a designation) and result in an L shape of the bracket arms 4, 5. The ends of the vertical arms 41, 42 and 51, 52 are connected to the bracket bearings 6, 7 via bracket flanges 46, 47 and 56, 57.

In addition to the setting of the distance between the bracket bearings 6, 7 by means of the spindle drive 9, it is possible to provide for setting of the distance of the bracket bearings 6, 7 from the crossmember 3 which can be realized in different ways.

Figure 5:
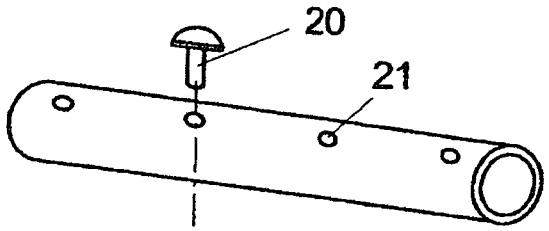
FIG. 5 shows a schematic and perspective illustration of a first apparatus for setting the bracket bearing articulation.
Figure 6:
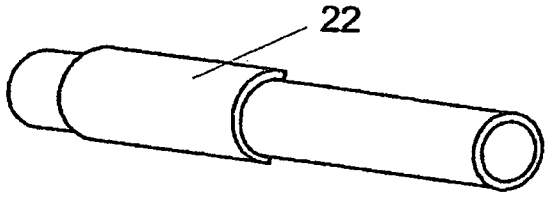
FIG. 6 shows a schematic and perspective illustration of a second apparatus for the bracket bearing articulation.
Figure 7:
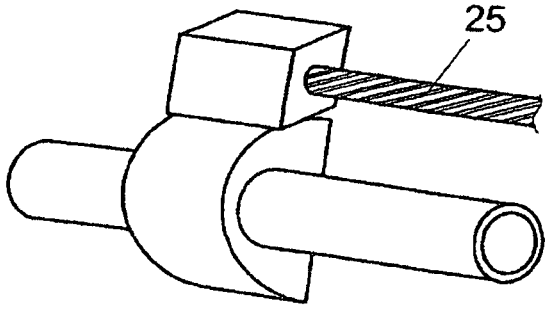
FIG. 7 shows a schematic and perspective partial view of a spindle drive for adjusting the articulation of the bracket bearings.

FIGS. 5 to 7 illustrate exemplary embodiments for setting the length of the bracket bearings 6, 7. In the exemplary embodiment illustrated schematically and perspectively in FIG. 5, the setting of the length comprises pins 20, which can be plugged both through the bracket flanges 46, 47 and 56, 57 and through the vertical arms 41, 42 and 51, 52 into positions predetermined by means of drilled holes 21 and therefore set a required or desired distance of the bracket bearings 6, 7 from the crossmember 3 for accommodating a spotlight housing.

In the embodiment shown in FIG. 6, the setting apparatus comprises plug-type sleeves 22, which can be used on the vertical arms of the bracket arms at notches provided and are supported, for example, on the bracket flanges 46, 47 and 56, 57 of the bracket bearings 6, 7.

As an alterative to this and corresponding to the spindle drive for setting the distance of the bracket bearings 6, 7 from one another, a spindle drive 25 can be provided and connected to the bracket bearings 6, 7 or the bracket flanges 46, 47 and 56, 57.

In order to select the distance of the bracket bearings 6, 7 from one another, in a first embodiment a selection of programmed values of the distance for different spotlight types can be carried out and input via the remote control means. By activating the spindle drive, the bracket arms are set to the input distance and in the process automatic centering of the center of gravity is performed.

As an alternative or in addition, remote control of the distance of the bracket bearings 6, 7 can be indicated, so that corresponding setting can be performed given known dimensions of the spotlight housing. Since the control device is programmable, the set value can be stored and, provided with an identification, approached directly for renewed setting of the distance.

The setting of the inclination of the spotlight 1 by means of pivoting the spotlight about the pivot axis 12 optionally takes place via programmed set values or by direct actual value inputting by means of remote control. Preferably, the maximum pivoting range is programmed by, for example, the limits of the pivoting range being approached and confirmed so that, in the event of a subsequent direct input of inclination settings, the maximum pivoting range is not exceeded. At the same time, sensitive setting is possible when inputting the limits by means of a corresponding extension of the setting range.

Preferably, the pivoting speed is continuously regulable and gentle starting and braking when setting the inclination of the spotlight 1 is ensured by PID regulation, which is provided in the control device of the adapter, drive and control module. Furthermore, the characteristic of the starting or braking response can be matched to the individual requirements of the operator. As an additional safety measure, the pivoting drive is provided with a friction coupling, which can be set from the outside, in order to avoid damage to the spotlight as a result of collision with objects or risk to personnel by means of limiting the maximum torque when pivoting the spotlight.

The invention claimed is:

1. A retaining bracket for a spotlight comprising:

a rigid frame construction having a crossmember and bracket arms at end sections thereof including bracket bearings arranged for accommodating said spotlight; and said crossmember comprising a central supporting bearing for connecting the retaining bracket to a supporting apparatus, said crossmember and said bracket arms being connected via synchronously adjustable coupling elements to adjust the distance of the bracket bearings from one another in a self-centering fashion for accommodating spotlight housings of different sizes while keeping said supporting bearing automatically in the central position of said crossmember without displacement of the center of gravity with respect to said supporting bearing.

2. The retaining bracket of claim 1, wherein the bracket bearings are capable of being pivoted about a horizontal pivot axis for setting an inclination of the spotlight.

3. The retaining bracket of claim 1, wherein the supporting bearing is connected rotatably to the supporting apparatus for rotating the spotlight about a vertical axis of rotation.

4. The retaining bracket of claim 1, wherein the crossmember and the bracket arms comprise mutually adjustable rods or tubes for adjusting the distance between the bracket bearings from one another and for adjusting a distance of the bracket from the crossmember.

5. The retaining bracket of claim 1, wherein the crossmember comprises a rectangular frame with cross tubes, which are connected via lateral flanges, and wherein the bracket arms are L-shaped and have horizontal and vertical arms, which are spaced apart with respect to one another by a length of lateral flanges of the crossmember and are connected to one another via cross arms, with the horizontal arms being connected to the coupling elements and the vertical arms being connected to the bracket bearings.

6. The retaining bracket of claim 5, wherein the coupling elements are adjustable along the cross tubes of the crossmember.

7. The retaining bracket of claim 6, wherein the coupling elements are synchronously adjustable via a drive device, which is connected to the crossmember.

8. The retaining bracket of claim 7, wherein the drive device comprises a spindle drive with a drive motor, at least one spindle and spindle nuts, which are connected to the coupling elements and which the at least one spindle engages.

9. The retaining bracket of claim 8, comprising one spindle, which is connected to the drive motor, with opposed threads, which engage the spindle nuts, which are connected to the coupling elements, with a left-handed thread on one side and a right-handed thread on the other side.

10. The retaining bracket of claim 8, comprising two spindles, which are connected to the drive motor and whose threads engage the spindle nuts, which are connected to the coupling elements.

11. The retaining bracket of claims 8, wherein the spindle is supported on the flanges of the crossmember.

12. The retaining bracket of claim 7, wherein the drive device is are connected at least partially via a friction coupling to the respective adapter or flange plate.

13. The retaining bracket of claim 1, further comprising an adapter, drive and control module, which is connected to the crossmember, with an adapter and flange plate for connecting the retaining bracket to the supporting apparatus, with a drive motor of a spindle drive and a drive motor for rotating the retaining bracket about a vertical axis of rotation, with a first sensor for detecting the rotary angle of the retaining bracket and with a control device, which is connected to the first sensor, a setpoint encoder and the drive motor.

14. The retaining bracket of claim 13, wherein the control device has a PID regulating device for regulating the starting and braking reaction of at least one of the drive devices of the retaining bracket.

15. The retaining bracket of claim 13, further comprising a remote control for driving at least some functions of the retaining bracket.

16. The retaining bracket of claim 15, wherein the remote control is connected to the control device of the retaining bracket via a Digital Multiplex (DMX) interface.

17. The retaining bracket of claim 15, wherein the remote control is wirelessly connected to the control device of the retaining bracket.

18. The retaining bracket of claim 13, wherein the vertical axis of rotation and horizontal pivot axis are coupled to rotary angle encoders, which emit a position signal to the control device of the adapter, drive and control module.

19. The retaining bracket of claim 13, wherein the distance between the bracket bearings is capable of being set by calling up stored values of spotlight housing data.

20. The retaining bracket of claim 13, further comprising a second sensor for detecting the distance between the bracket bearings and/or a contact pressure between the bracket bearings and the spotlight housing.

21. The retaining bracket of claim 13, wherein the bracket bearings have a pivot drive for rotating the adapter or flange plates, which are connected to the bracket bearings, for accommodating the spotlight housing and setting an inclination of the spotlight about the pivot axis.

22. The retaining bracket of claim 21, wherein the adapter or flange plates have a quick-action fastener device.

23. The retaining bracket of claim 21, wherein the pivot drive is connected to the control device of the adapter, drive and control module.

24. The retaining bracket of claim 21, wherein the adapter and flange plate is connected to a safety suspension device for suspended operation of the retaining bracket.

25. The retaining bracket of claim 1, wherein the distance of the bracket bearings from the crossmember is adjustable and is capable of being set.

26. The retaining bracket of claim 25, further comprising a spindle or telescope drive, which is connected to the bracket bearings and the crossmember.

27. The retaining bracket of claim 1, wherein the crossmember is adjustable in length for adjusting the distance between the bracket bearings from one another.

28. A retaining bracket for a spotlight with bracket bearings, which are arranged at the ends of the retaining bracket for accommodating a spotlight housing of the spotlight and comprising a central supporting bearing for connecting the retaining bracket to a supporting apparatus, wherein a distance of the bracket bearings from one another is adjustable in a self-centering fashion by a drive of an adapter drive and control module for accommodating spotlight housings of different sizes, wherein the adapter, drive and control module is connected to a focusing drive device for adjusting the light exit angle of the spotlight.

29. The retaining bracket of claim 28, wherein the focusing drive device is arranged in a focusing transmission housing, which can be flange-connected to the spotlight housing, and is connected to the adapter, drive and control module via a control and power supply line.

30. A retaining bracket for a spotlight with bracket bearings, which are arranged at the ends of the retaining bracket for accommodating a spotlight housing of the spotlight and comprising a central supporting bearing for connecting the retaining bracket to a supporting apparatus, wherein a distance of the bracket bearings from one another is adjustable in a self-centering fashion by a drive for accommodating spotlight housings of different sizes, wherein the bracket bearings are capable of being pivoted about a horizontal pivot axis for the purpose of setting an inclination of the spotlight, and wherein a maximum pivoting range of the spotlight is programmable and a program-controlled switch-off at limit is provided.

31. A retaining bracket for a spotlight with bracket bearings, which are arranged at the ends of the retaining bracket for accommodating a spotlight housing of the spotlight and comprising a central supporting bearing for connecting the retaining bracket to a supporting apparatus, wherein a distance of the bracket bearings from one another is adjustable in a self-centering fashion by a drive for accommodating spotlight housings of different sizes, wherein the bracket bearings are capable of being pivoted about a horizontal pivot axis for the purpose of setting an inclination of the spotlight, and wherein a pivoting speed of the spotlight is continuously regulable.

32. A retaining bracket for a spotlight comprising:

a module for pivotably connecting to a support structure;

a crossmember coupled to the module and comprising a center and having an adjustable length;

a first bracket arm extending from the crossmember;

a second bracket arm extending from the crossmember and being spaced apart from the first bracket arm;

a first bracket bearing mounted to the first bracket arm for supporting the spotlight; and a second bracket bearing mounted to the second bracket arm for supporting the spotlight, wherein adjusting the length of the crossmember adjusts a spacing between the first and second bracket arms, wherein during adjustment said center is stationary.

33. A retaining bracket for a spotlight with bracket bearings, which are arranged at the ends of the retaining bracket for accommodating a spotlight housing of the spotlight and comprising a central supporting bearing for connecting the retaining bracket to a supporting apparatus, wherein a distance of the bracket bearings from one another is adjustable in self-centering fashion by a drive for accommodating spotlight housings of different sizes.

34. The retaining bracket of claim 33, wherein a distance of the bracket bearings from the supporting bearing is adjustable.

35. The retaining bracket of claim 33, wherein the bracket bearings are capable of being pivoted about a horizontal pivot axis for the purpose of setting an inclination of the spotlight.

36. The retaining bracket of claim 35, wherein a maximum pivoting range of the spotlight is programmable and a program-controlled switch-off at limit is provided.

37. The retaining bracket of claim 35, wherein a pivoting speed of the spotlight is continuously regulable.

38. The retaining bracket of claim 33, wherein the supporting bearing is connected rotatably to the supporting apparatus for the purpose of rotating the spotlight about a vertical axis of rotation.

39. The retaining bracket bearing of claim 33, wherein an adapter, drive and control module is connected to a focusing drive device for adjusting a light exit angle of the spotlight.

40. The retaining bracket of claim 39, wherein the focusing drive device is arranged in a focusing transmission housing, which can be flange-connected to the spotlight housing, and is connected to the adapter, drive and control module via a control and power supply line.

* * * * *